US010843038B1

(12) United States Patent
Gajewski et al.

(10) Patent No.: US 10,843,038 B1
(45) Date of Patent: Nov. 24, 2020

(54) EXERCISE MACHINES HAVING A LOCKING DEVICE FACILITATING RELATIVE POSITIONING OF FRAME MEMBERS

(71) Applicant: Brunswick Corporation, Mettawa, IL (US)

(72) Inventors: Joseph Gajewski, Schaumburg, IL (US); William J. Kreuger, Bloomingdale, IL (US); Thomas M. Niec, Elmwood Park, IL (US); Zhenyu Tian, Berkeley, CA (US)

(73) Assignee: Life Fitness, LLC, Rosemont, IL (US)

( * ) Notice: Subject to any disclaimer, the term of this patent is extended or adjusted under 35 U.S.C. 154(b) by 21 days.

(21) Appl. No.: 16/218,814

(22) Filed: Dec. 13, 2018

(51) Int. Cl.
*A63B 22/06* (2006.01)
*A63B 22/00* (2006.01)
*A63B 21/00* (2006.01)

(52) U.S. Cl.
CPC ..... *A63B 22/0605* (2013.01); *A63B 21/4033* (2015.10); *A63B 22/0023* (2013.01); *A63B 2022/0652* (2013.01); *A63B 2225/093* (2013.01)

(58) Field of Classification Search
CPC ..... A63B 22/0605; A63B 22/0023; A63B 21/4033; A63B 2022/0652; A63B 2225/093
See application file for complete search history.

(56) References Cited

U.S. PATENT DOCUMENTS 3,953,025 A * 4/1976 Mazman ..... A63B 21/015 482/118
4,113,221 A * 9/1978 Wehner ..... A47C 3/34 248/408

(Continued)

FOREIGN PATENT DOCUMENTS

| | | |
|---|---|---|
| AU | 2011319567 B9 | 4/2012 |
| CN | 201578512 U | 9/2010 |
| JP | 1999020768 A | 1/1999 |

OTHER PUBLICATIONS

NordicTrack GX 4.7 Recumbent Bike Review, Jun. 9, 2016, https://indoorsfitness.com/nordictrack-gx4-7-recumbent-ike-review/, Retrieved on Feb. 8, 2018.

(Continued)

*Primary Examiner* — Garrett K Atkinson
(74) *Attorney, Agent, or Firm* — Andrus Intellectual Property Law, LLP

(57) ABSTRACT

An exercise machine has a first frame member, a second frame member that is movable with respect to the first frame member, and a locking device having at least one cam that is rotatable into and between a locked position in which the cam abuttingly engages and thereby retains the second frame member in position with respect to the first frame member and an unlocked position in which the cam is spaced from and thereby frees the second frame member for movement with respect to the first frame member. The cam has an engagement surface with a contour that follows a logarithmic spiral curve defined by the following parametric equations: $x(t)=r(t)\cos(t)=ae^{bt}\cos(t)$, and $y(t)=r(t)\sin(t)=ae^{bt}\sin(t)$, wherein e is the base of natural logarithms and a and b are arbitrary positive real constants.

20 Claims, 11 Drawing Sheets

(56) References Cited

U.S. PATENT DOCUMENTS

| | | | | |
|---|---|---|---|---|
| 6,958,032 | B1 * | 10/2005 | Smith | A63B 21/023 482/121 |
| 7,314,434 | B2 * | 1/2008 | Chen | A63B 21/0051 188/164 |
| 7,364,535 | B1 | 4/2008 | Rosenow et al. | |
| 7,470,220 | B2 * | 12/2008 | Hernandez | A63B 21/012 188/25 |
| 7,740,223 | B2 * | 6/2010 | Field, Jr. | A63B 29/024 248/694 |
| 7,802,770 | B2 * | 9/2010 | Field, Jr. | A63B 29/024 248/694 |
| 7,803,095 | B1 * | 9/2010 | LaGree | A63B 22/0012 482/140 |
| 7,874,615 | B2 | 1/2011 | Huyck et al. | |
| 8,021,127 | B2 | 9/2011 | De Larminat | |
| 8,272,999 | B2 | 9/2012 | Huyck et al. | |
| 8,496,297 | B2 | 7/2013 | Huyck et al. | |
| 9,707,436 | B1 | 7/2017 | Atwood et al. | |

OTHER PUBLICATIONS

Camalot, Black Diamond Equipment, https://www.blackdiamondequipment.com/en_US/climbing-cams-stoppers-nuts-hexes/camalottm-BD262104_cfg.html#start=2, Retrieved on Dec. 6, 2018.

Wraparound Rope Cleats, McMaster-Carr, https://www.mcmaster.com/cleats, Retrieved on Dec. 6, 2018.

Pull-Through Rope Cleats, McMaster-Carr, https://www.mcmaster.com/cleats, Retrieved on Dec. 6, 2018.

Press-In Rope Cleats, McMaster-Carr, https://www.mcmaster.com/cleats, Retrieved on Dec. 6, 2018.

Rope Guides, McMaster-Carr, https://www.mcmaster.com/cleats, Retrieved on Dec. 6, 2018.

Webbing Guides, McMaster-Carr, https://www.mcmaster.com/cleats, Retrieved on Dec. 6, 2018.

Tie-Down Rings, McMaster-Carr, https://www.mcmaster.com/cleats, Retrieved on Dec. 6, 2018.

Webbing Guides for Snap-In Load-Securing Track, McMaster-Carr, https://www.mcmaster.com/cleats, Retrieved on Dec. 6, 2018.

Cleated Belting for Slider-Bed Conveyors, McMaster-Carr, https://www.mcmaster.com/cleats, Retrieved on Dec. 6, 2018.

High-Traction Work Shoe Covers, McMaster-Carr, https://www.mcmaster.com/cleats, Retrieved on Dec. 6, 2018.

Ice Grippers, McMaster-Carr, https://www.mcmaster.com/cleats, Retrieved on Dec. 6, 2018.

Rectangular Duct and Fittings, McMaster-Carr, https://www.mcmaster.com/cleats, Retrieved on Dec. 6, 2018.

* cited by examiner

EXERCISE MACHINES HAVING A LOCKING DEVICE FACILITATING RELATIVE POSITIONING OF FRAME MEMBERS

FIELD

The present disclosure relates to exercise machines and more particularly to exercise machines having frame members that are manually position-able with respect to each other.

BACKGROUND

The following U.S. Patents are incorporated herein by reference in entirety:

U.S. Pat. No. 9,707,436 discloses a connector apparatus that connects a first component of an exercise machine to a second component of the exercise machine. The connector apparatus comprises a rack coupled to the first component; a pinion gear coupled to the second component, the pinion gear being configured to mate with the rack such that the pinion gear can roll along the rack; a one-way bearing that allows the pinion gear to roll along the rack in a first direction and prevents the pinion gear from rolling along the rack in an opposite, second direction; and a handle that is coupled to the one-way bearing. The handle is configured to move back and forth between a first position wherein the pinion gear is mated with the rack and allowed by the one-way bearing to roll along the rack in the first direction and prevented by the one-way bearing from rolling along the rack in the second direction; and a second position wherein the pinion gear is separated from the rack and is freely movable in the first and second directions.

U.S. Pat. Nos. 8,496,297; 8,272,999; and 8,021,127 disclose several mechanisms for permitting a user to adjust a seat on a stationary exercise bicycle. The described mechanisms can be used to adjust the height of the seat or the fore and aft positioning of the seat on an upright type bicycle. Each of the described mechanisms can be configured to provide users with an optimum seat position and with a convenient latch mechanism to adjust the position of the seat.

U.S. Pat. No. 7,874,615 discloses several mechanisms for permitting a user to adjust the seat on a stationary exercise bicycle. The described mechanisms can be used to adjust the height of the seat or the fore and aft positioning of the seat on an upright type bicycle. Each of the described mechanisms can be configured to provide users with an optimum seat position and with a convenient latch mechanism to adjust the position of the seat. Also described is a seat mechanism for use with a recumbent type stationary exercise bicycle where the seat can be adjusted along the longitudinal length of the bicycle.

U.S. Pat. No. 7,364,535 discloses an exercise apparatus having a biased tolerance-compensating engagement system between a seat-supporting carriage and a tubular support column to provide zero clearance between adjustment rollers and the support column, to minimize wobble during user adjustment.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter. In certain examples disclosed herein, an exercise machine has a first frame member, a second frame member that is movable with respect to the first frame member, and a locking device with at least one cam that is rotatable into and between a locked position in which the cam abuttingly engages and thereby retains the second frame member in position with respect to the first frame member and an unlocked position in which the cam is spaced from the second frame member and thereby frees the second frame member for movement with respect to the first frame member. The cam has an engagement surface with an outer contour that follows a logarithmic spiral curve defined by the following parametric equations: $x(t)=r(t)\cos(t)=ae^{bt}\cos(t)$, and $y(t)=r(t)\sin(t)=ae^{bt}\sin(t)$, wherein e is the base of natural logarithms and a and b are arbitrary positive real constants.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
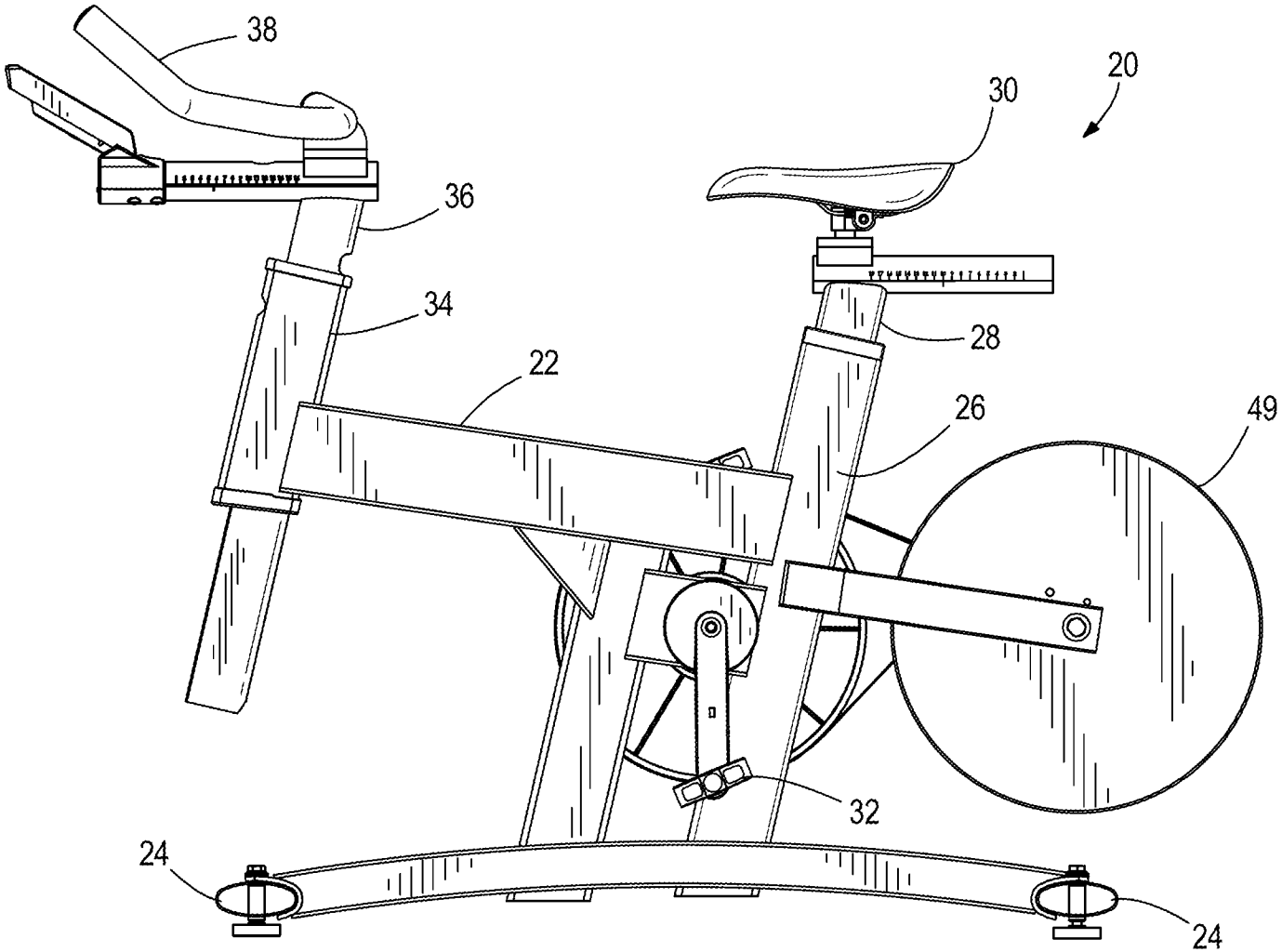
FIG. 1 is a side view of an exemplary exercise machine configured according to concepts of the present disclosure.

FIG. 1 depicts an exercise machine, which in the illustrated example is a stationary bicycle 20. The stationary bicycle 20 has a base frame 22, a pair of ground supporting members 24, and a generally vertically extending rear support column 26 that supports a seat post 28. The seat post 28 supports a seat 30 and is coupled to the rear support column 26 in a telescoping arrangement via which the seat post 28 is telescopically movable upwardly with respect to the rear support column 26 to raise the seat 30 and telescopically movable downwardly with respect to the rear support column 26 to lower the seat 30. The stationary bicycle 20 also has a generally vertically extending front support column 34 that supports a handle post 36. The handle post 36 supports a pair of handles 38 and is coupled to the front support column 34 in a telescoping arrangement via which the handle post 36 is telescopically movable upwardly with respect to the front support column 34 to raise the handles 38 and telescopically movable downwardly with respect to the front support column 34 to lower the handles 38. As is conventional, the stationary bicycle 20 has foot pedals 32 via which a user sitting on the seat 30 and grasping the handles 38 can perform a cycling exercise motion. A conventional resistance mechanism, such as a flywheel 49, is coupled to the foot pedals 32 and provides resistance to the cycling exercise motion.

Through research and development, the present inventors have determined that it is desirable to provide adjustment mechanisms for exercise machines, for example seat adjustment mechanisms for adjusting the seat shown in FIG. 1 or handle adjustment mechanisms for adjusting the handles shown in FIG. 1, which allow for infinite relative positioning of the respective components without utilizing complicated mechanisms such as gas shocks or set screws, which are often difficult to operate and can be prone to failure.

Figure 2:
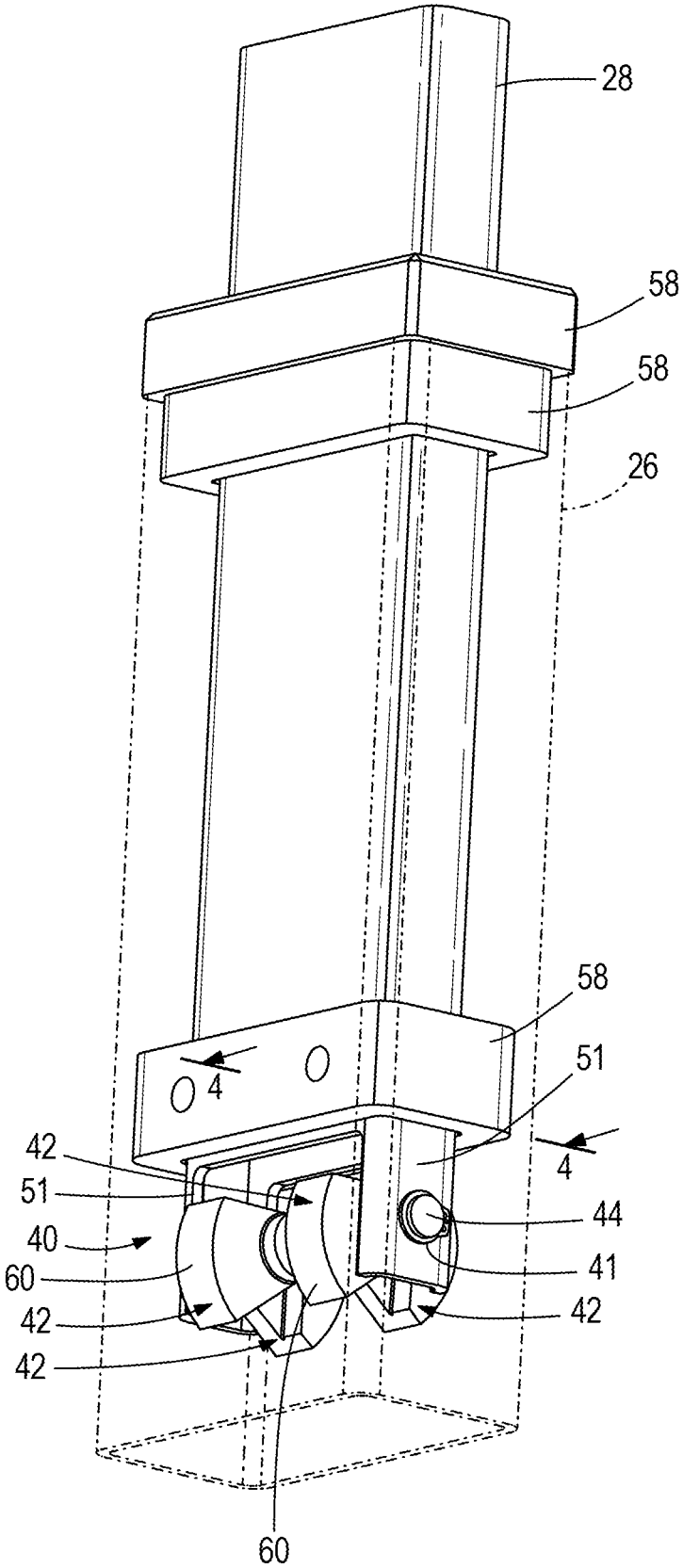
FIG. 2 is a perspective view of first and second frame members in the exercise machine and a first embodiment of a locking device according to the present disclosure.
Figure 3:
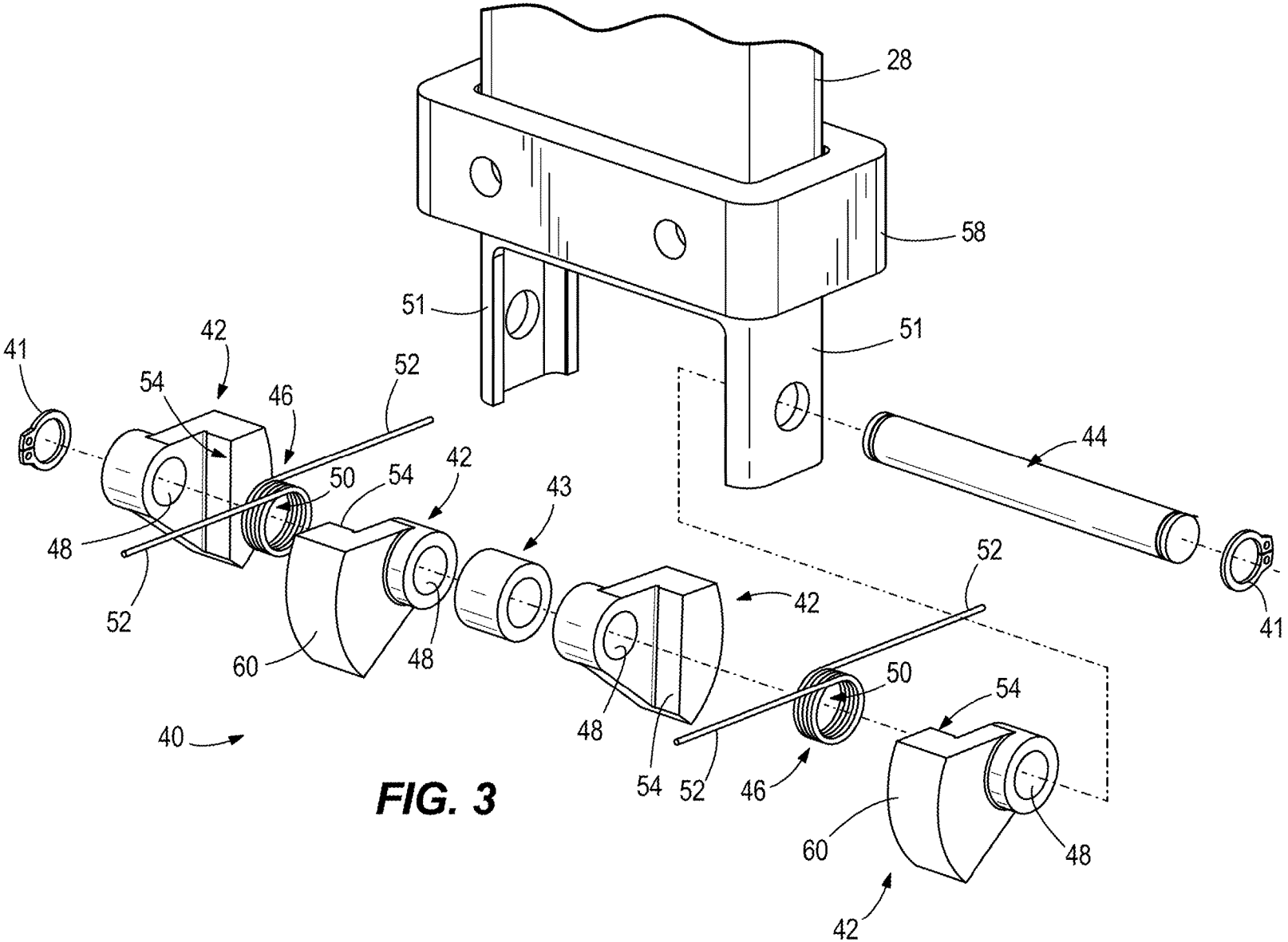
FIG. 3 is an exploded view of the first embodiment of the locking device.

FIGS. 2 and 3 depict a first embodiment of a locking device 40 according to the present disclosure, which is advantageously configured to retain the seat post 28 in an infinite number of desired positions with respect to the rear support column 26. The locking device 40 includes two identical pairs of cams 42 which are mounted on a common pivot axle 44. The pivot axle 44 is supported by opposing yoke arms 51 extending from the lower end of the seat post 28. Retainer rings 41 retain the ends of the pivot axle 44 in place with respect to the yoke arms 51. A spacer 43 is mounted on the pivot axle 44 and spaces the pairs of cams 42 from each other. The cams 42 in each pair are oppositely oriented (i.e. are outwardly opposing each other) and are caused by a torsion spring 46 to automatically rotate about the pivot axle 44 towards the locked position shown in FIG. 2. More specifically, each cam 42 has a through-bore 48 through which the pivot axle 44 extends so that the cam 42 can freely pivot about the pivot axle 44. The torsion spring 46 is a wound coil that defines a through-bore 50. The through-bore 50 of the torsion spring 46 is disposed on the pivot axle 44 axially between the opposing cams 42. The coil of the torsion spring 46 has opposite ends 52 that abut bearing surfaces 54 on opposing side faces 55 of the cams 42. During assembly, the opposite ends 52 are rotated (torqued) towards each other and then engaged with the bearing surfaces 54 so that the opposing cams 42 naturally remain under a constant spring bias force, which forces the opposing cams 42 rotationally away from each other about the pivot axle 44 and into the locked position shown in FIG. 4 and further described herein below.

Figure 4:
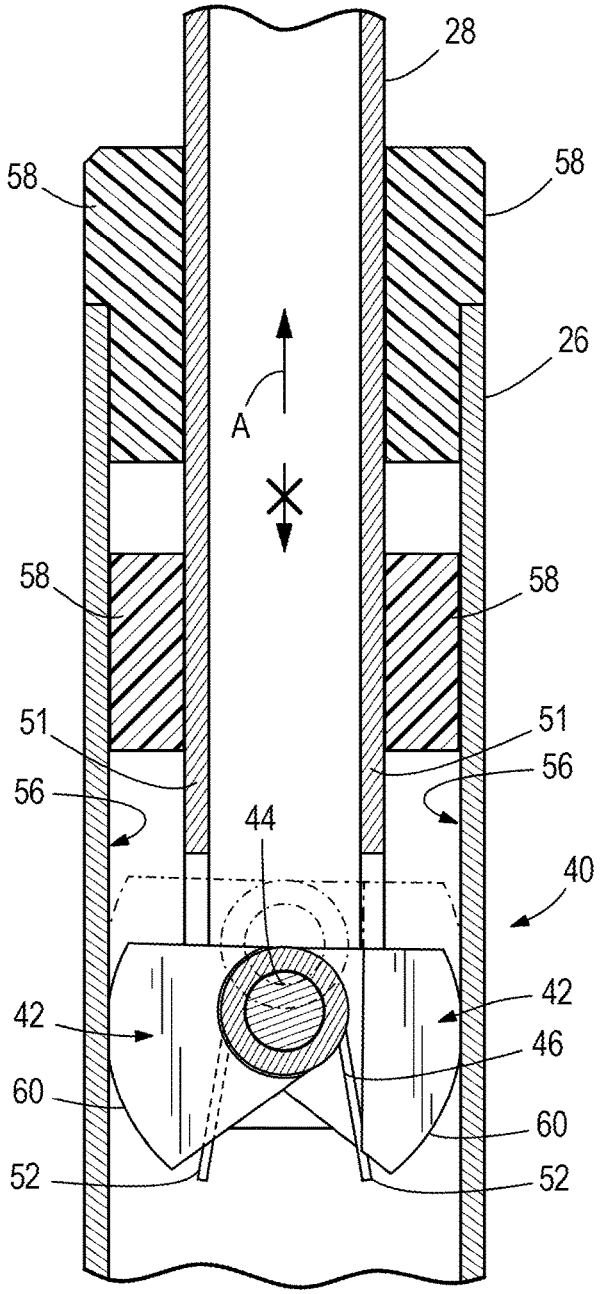
FIG. 4 is a sectional side view of the first and second frame members, showing the first embodiment of the locking device in a locked position.

FIG. 4 depicts, in solid line format: the seat post 28, the rear support column 26, and the locking device 40. The locking device 40 is depicted in a locked position in which the seat post 28 is securely retained in place with respect to the rear support column 26 and can support the weight of the seat post 28 and seat 30. In the illustrated example, the rear support column 26 has oppositely oriented and inwardly facing engagement surfaces 56. Slide bearings 58 are located radially between the inwardly facing engagement surfaces 56 and the seat post 28, thus enabling smooth telescoping movement of the seat post 28 with respect to the rear support column 26 into and out of the position shown in FIG. 4. The configuration of the slide bearings 58 can vary from what is shown and for example can be affixed to the inwardly facing engagement surfaces 56 of the rear support column 26 or to the seat post 28. Different combinations and locations of the slide bearings 58 are contemplated. The pairs of cams 42 are disposed in the rear support column 26 and abut the inwardly facing engagement surfaces 56, so as to engage with the inwardly facing engagement surfaces 56 in a frictional engagement when the locking device 40 is in the locked position. The torsion springs 46 apply the above-described spring bias force onto the cams 42, which biases the cams 42 into the depicted locked position. The spring bias force is strong enough to force the pair of cams 42 into abutting engagement with the inwardly facing engagement surfaces 56 so that the cams 42 remain in contact with the inwardly facing engagement surfaces 56 with enough force to frictionally retain the seat post 28 and seat 30 in position under normal force of gravity.

Referring to FIG. 4, as shown in dashed line format, each cam 42 is sized and shaped such that it is freely slide-able upwardly along the inwardly facing engagement surfaces 56 of the rear support column 26 as the seat post 28 is manually pulled upwardly and outwardly with respect to the rear support column 26 so as to raise the seat 30 (see arrow A). The spring bias force is large enough to force the cam 42 into abutting engagement with the engagement surfaces 56, but small enough to permit the cams 42 to pivot inwardly and permit noted upward sliding movement of the cam 42 along the engagement surface 56 when the seat post 28 is manually raised with respect to the rear support column 26 in the direction of arrow A. As will be described further herein below, each cam 42 is specially sized and shaped so that it will abuttingly engage with the inwardly facing engagement surfaces 56 of the rear support column 26 (under bias from the torsion spring 46) and thereby lock with and prevent lowering movement of the seat post 28 into the rear support column 26, for example when a user sits on and applies the force of his or her weight on the seat 30.

Through research and development, the present inventors have determined that it is desirable to configure the locking device 40 in a manner that provides secure engagement between the seat post 28 and the rear support column 26 when the seat post 28 is placed under a wide range of downward forces. It is desirable to configure the cams 42 in such a way that, regardless of the degree of rotation of the cam 42 about the pivot axle 44, a constant contact angle $\propto$ is provided at the interface of the cam 42 and the inwardly facing engagement surface 56 of the support column 26.

Figure 6:
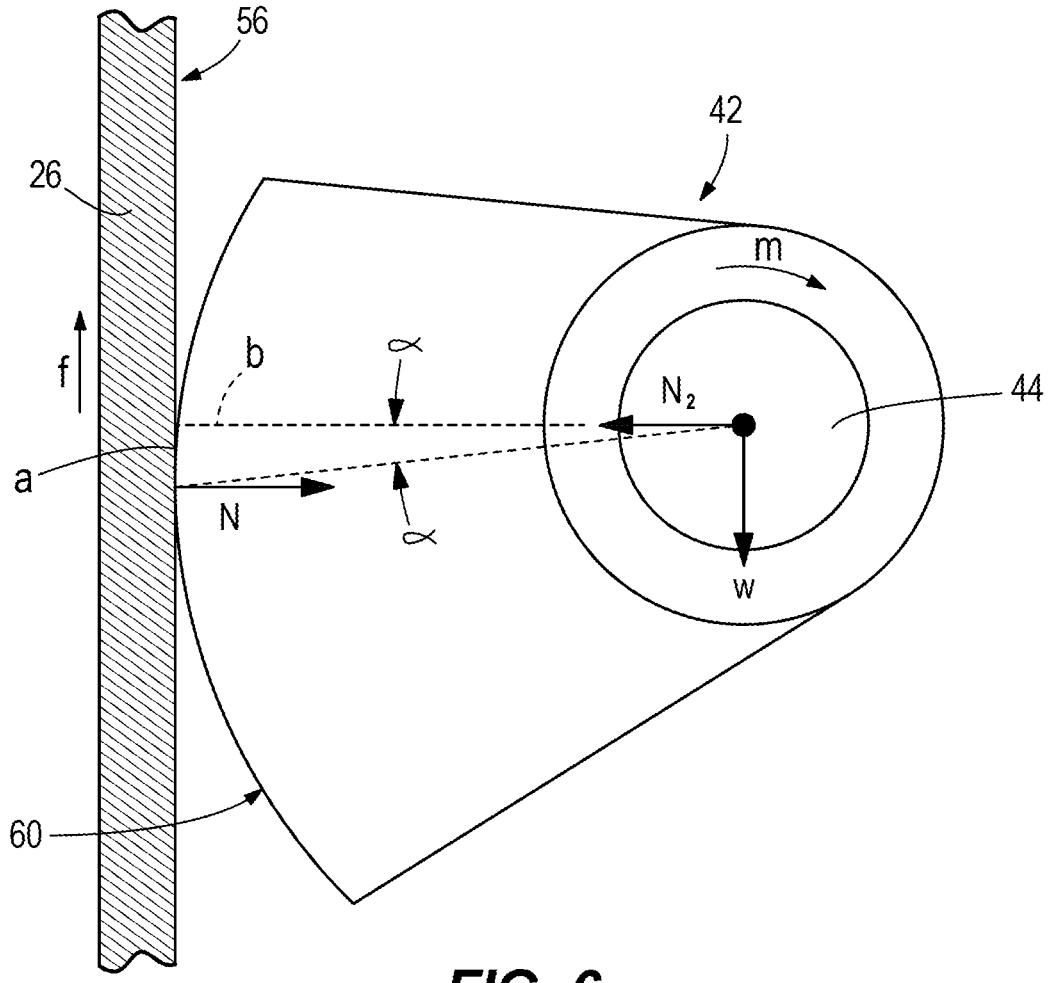
FIG. 6 is a schematic view of a cam of the locking device having an engagement surface having an outer contour configured according to concepts of the present disclosure.

Referring now to FIG. 6, each cam 42 has an engagement surface 60 having a contour that follows a logarithmic spiral curve defined by the following parametric equation:

$$x(t)=r(t)\cos(t)=ae^{bt}\cos(t)$$

$$y(t)=r(t)\sin(t)=ae^{bt}\sin(t)$$

Wherein e is the base of natural logarithms and a and b are arbitrary positive real constants. The mathematical curve is applied to the physical shape of the cam surface by placing the origin of the polar coordinates at the center of rotation of the cams. The side view of cam surfaces coincides with a section of the mathematical curve. Due to the self-similar property of the mathematical curve, selecting different sections of the curve does not change the shape of the contour but the size of it. The size of the contour can be also changed by varying parameters a and b.

Advantageously, because of the contour of the engagement surface 60, regardless of the degree of rotation of cam 42 about the pivot axis, substantially the same contact angle remains present at interface between locking device 40 and the rear support column 26. Thus, a greater downward force on the seat 30 will create a greater normal force between the cams 42 and rear support column 26. As a user applies a greater downward force on the seat 30, the cams 42 will rotate about their pivot axis and create a greater normal force N between the cams 42 and the rear support column 26. Referring to FIG. 6, the value for N increases as the downward force on the seat 30 (W) is increased. The inventors have determined that this is important to maintain a constant, correct contact angle $\propto$. If the angle $\propto$ is too steep, the locking device 40 will not provide a large enough N because the value of b will increase. If the angle is too shallow, the locking device 40 could potentially deform the rear support column 26 at the interface and allow the cams 42 to toggle over. Providing a cam 42 with a contour having the logarithmically curved engagement surface 60 allows the angle to remain constant, even in cases where one or more of the respective components deform under the weight of the user. Also, in the illustrated example, the spacer 43 advantageously retains the cams 42 outwardly on the pivot axle 44 so that the cams 42 engage with the rear support column 26 close to its sidewalls, where it is most resistant to deformation.

Figure 5:
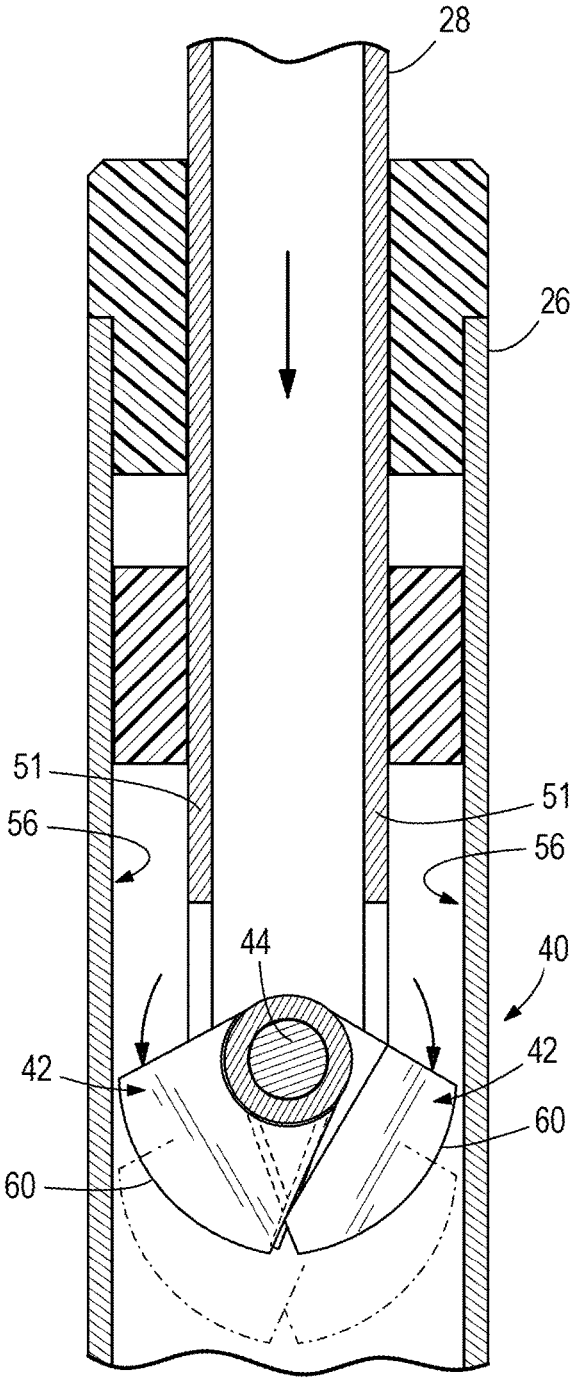
FIG. 5 is a sectional side view of the first and second frame members, showing the first embodiment of the locking device in an unlocked position.
Figure 7:
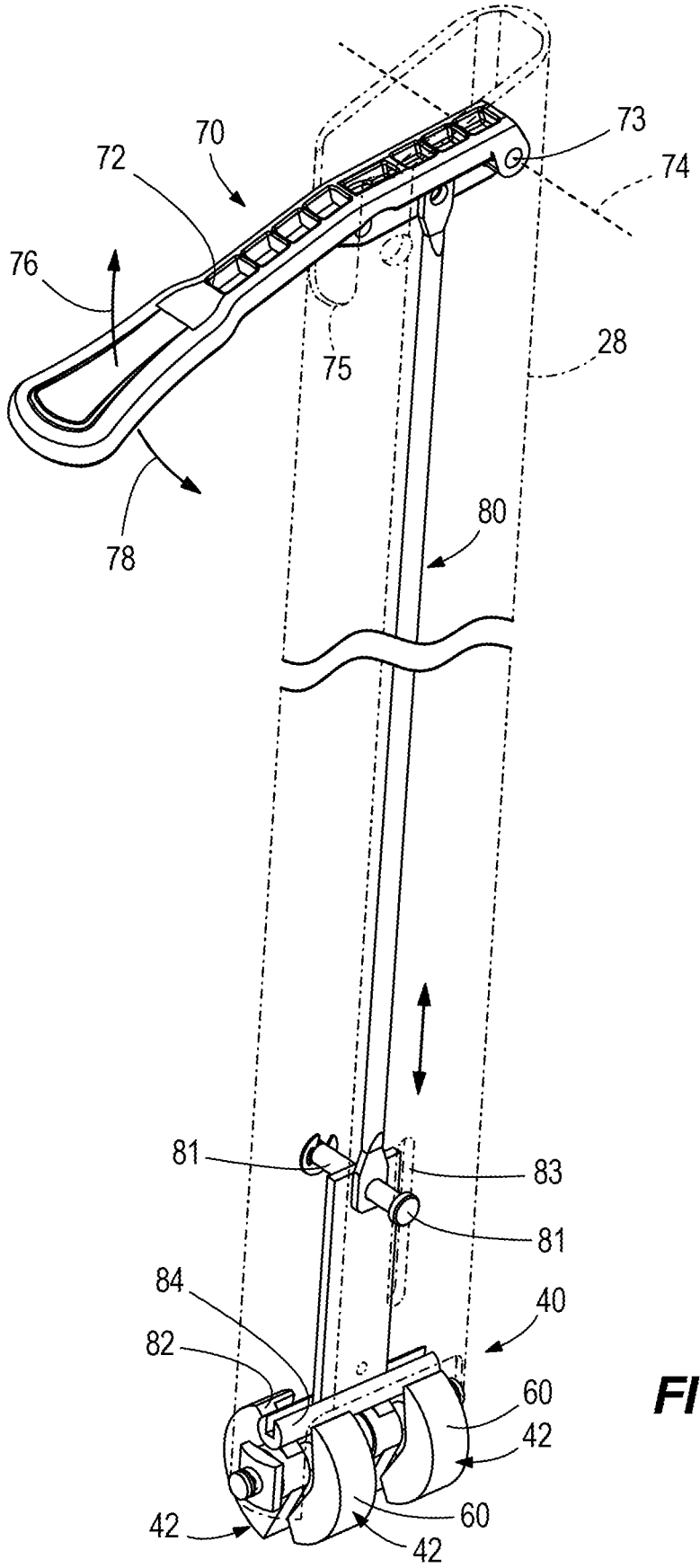
FIG. 7 is a perspective view of first and second frame members and the first embodiment incorporated with a release device according to the present disclosure.
Figure 8:
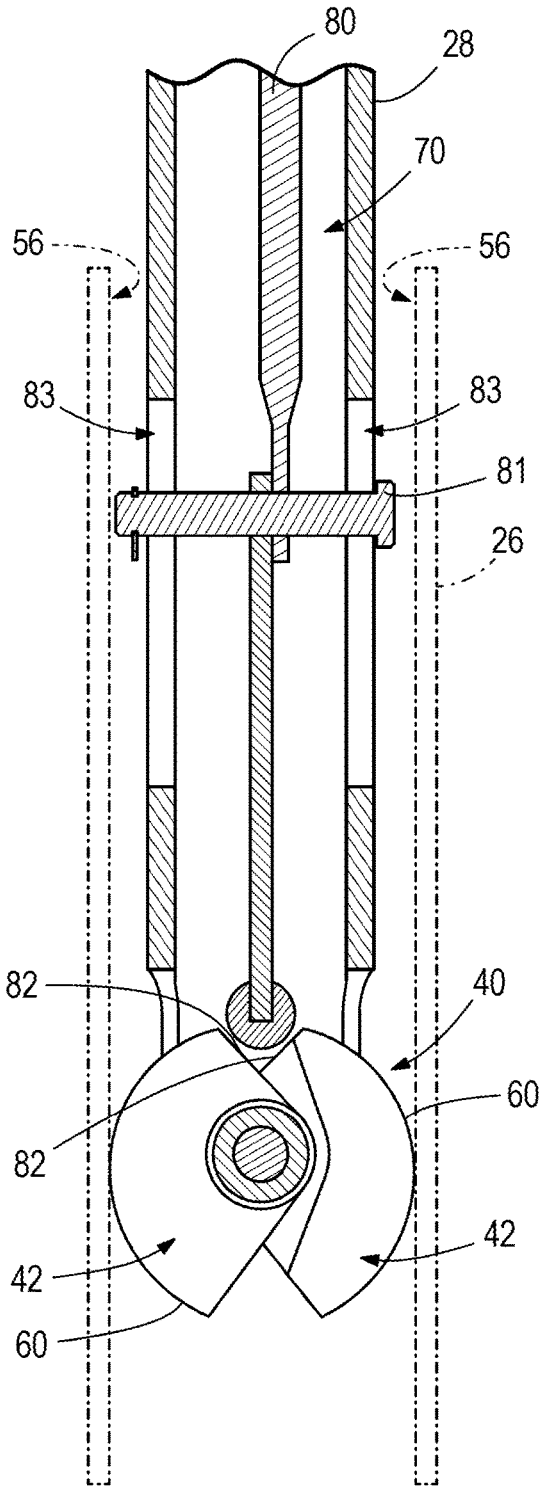
FIG. 8 is a sectional side view of the first and second frame members, showing the arrangement of FIG. 7 in the locked position.
Figure 9:
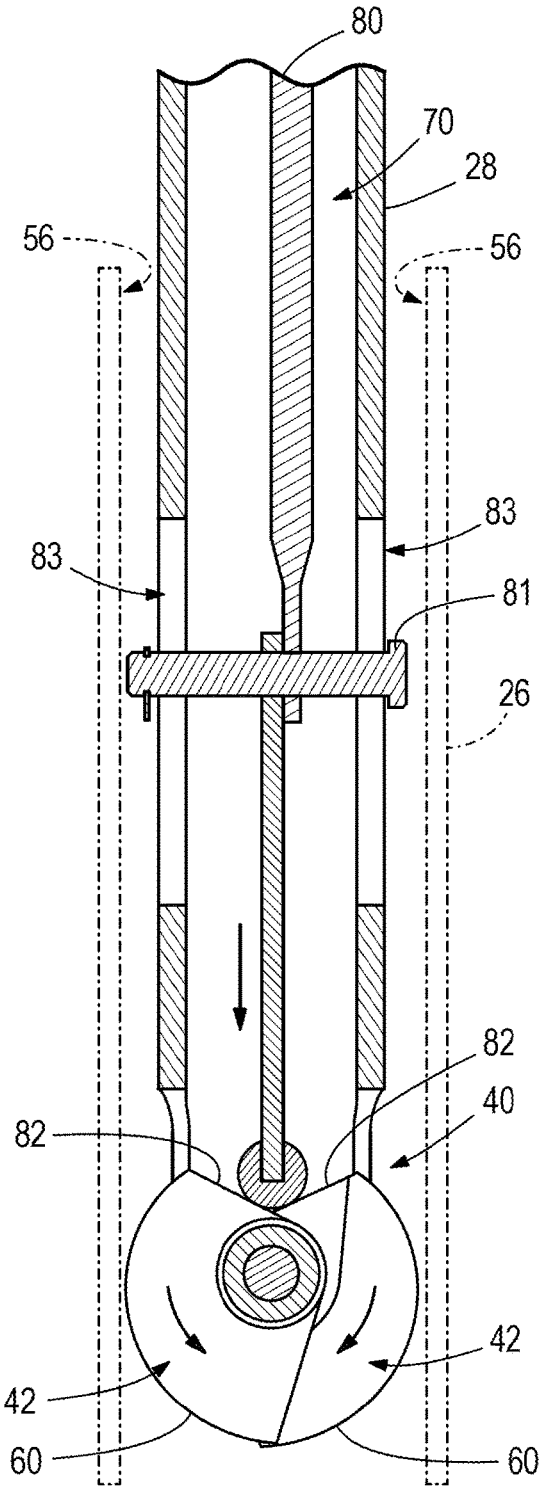
FIG. 9 is a sectional side view of the first and second frame members, showing the arrangement of FIG. 7 in the unlocked position.

The stationary bicycle 20 can also include means for manually releasing the pair of cams 42 from engagement with the inwardly facing engagement surfaces 56, as shown in FIG. 5, thereby permitting movement of the seat post 28 in either of the telescoping directions with respect to the rear support column 26. One non-limiting example is shown in FIGS. 7-9, wherein the release device 70 includes a handle 72 that is pivotable with respect to the seat post 28 about a pivot axle 73, which defines a handle pivot axis 74. The pivot axle 73 is connected to opposing sidewalls of the seat post 28 and the handle 72 is pivotable about the pivot axle 73 within a channel 75 formed in a sidewall of the seat post 28. Pivoting the handle 72 in a first direction, as shown at arrow 76, unlocks the locking device 40. Pivoting the handle 72 in an opposite second direction, as shown at arrow 78, locks the locking device 40. The release device 70 further includes a push rod 80 coupled to the handle 72 and extending into the interior of the seat post 28. The handle 72 and push rod 80 are coupled together such that pivoting the handle 72 in the first direction 76 moves the push rod 80 towards the locking device 40 and, as further described below, unlocks the locking device 40. Pivoting the handle 72 in the second direction 78 moves the push rod 80 away from the locking device 40 and unlocks the locking device 40. A guide pin 81 radially extends from the push rod 80 and into alignment slots 83 formed in the sidewalls of the seat post 28. The guide pins 81 and alignment slots 83 guide axial movement of the push rod 80 in the seat post 28 as the handle 72 is pivoted in the first and second directions 76, 78.

The push rod 80 comprises upper and lower rod portions that are coupled together by the guide pins 81; however this can vary and in other examples the push rod 80 can be formed as one rod or as more than two rod portions. Referring to FIGS. 8 and 9, each of the cams 42 has an upper angular camming surface 82 that is engaged by an engagement member 84 on the end of the push rod 80 when the handle 72 is pivoted in the first direction 76. In the illustrated example, the engagement member 84 is a cylindrical, laterally extending rod and the camming surfaces 82 of the respective pairs of cams 42 are angularly sloped with respect to the push rod 80 and face each other such that movement of the engagement member 84 towards the pairs of cams 42 engages all the camming surfaces 82 at once by wedging in between opposing camming surfaces 82 and thereby pushing the opposing camming surfaces 82 in the pairs of cams 42 apart from each other, thus rotating all the respective cams 42 into the unlocked position, as shown in FIG. 9. Rotation of the cams 42 as shown in FIG. 9 separates the engagement surfaces 60 of the cams 42 from the inwardly facing engagement surfaces 56 of the rear support column 26, thus freeing the seat post 28 for movement relative to the rear support column 26. Movement of the engagement member 84 away from the camming surfaces 82 allows the torsion springs 46 (see FIG. 3) to bias the cams 42 back into the locked position shown in FIG. 8, in which the engagement surfaces 60 of the cams 42 abuttingly engage the inwardly facing engagement surfaces 56 of the rear support column 26.

It should be understood that in other examples the locking device 40 can be utilized to retain other members of the exercise machine in position with respect to each other, for example the handle post 36 with respect to the front support column 34. It should also be recognized that while the locking device 40 is coupled to and travels with the seat post 28 as the seat post 28 is telescopically moved relative to the rear support column 26; this is not limiting, as will be evident from the description of the second embodiment herein below. In other examples contemplated by the present disclosure, two or more locking devices 40 can be utilized to lock each travel direction of a frame member, for example in a recumbent bike seat application.

Figure 10:
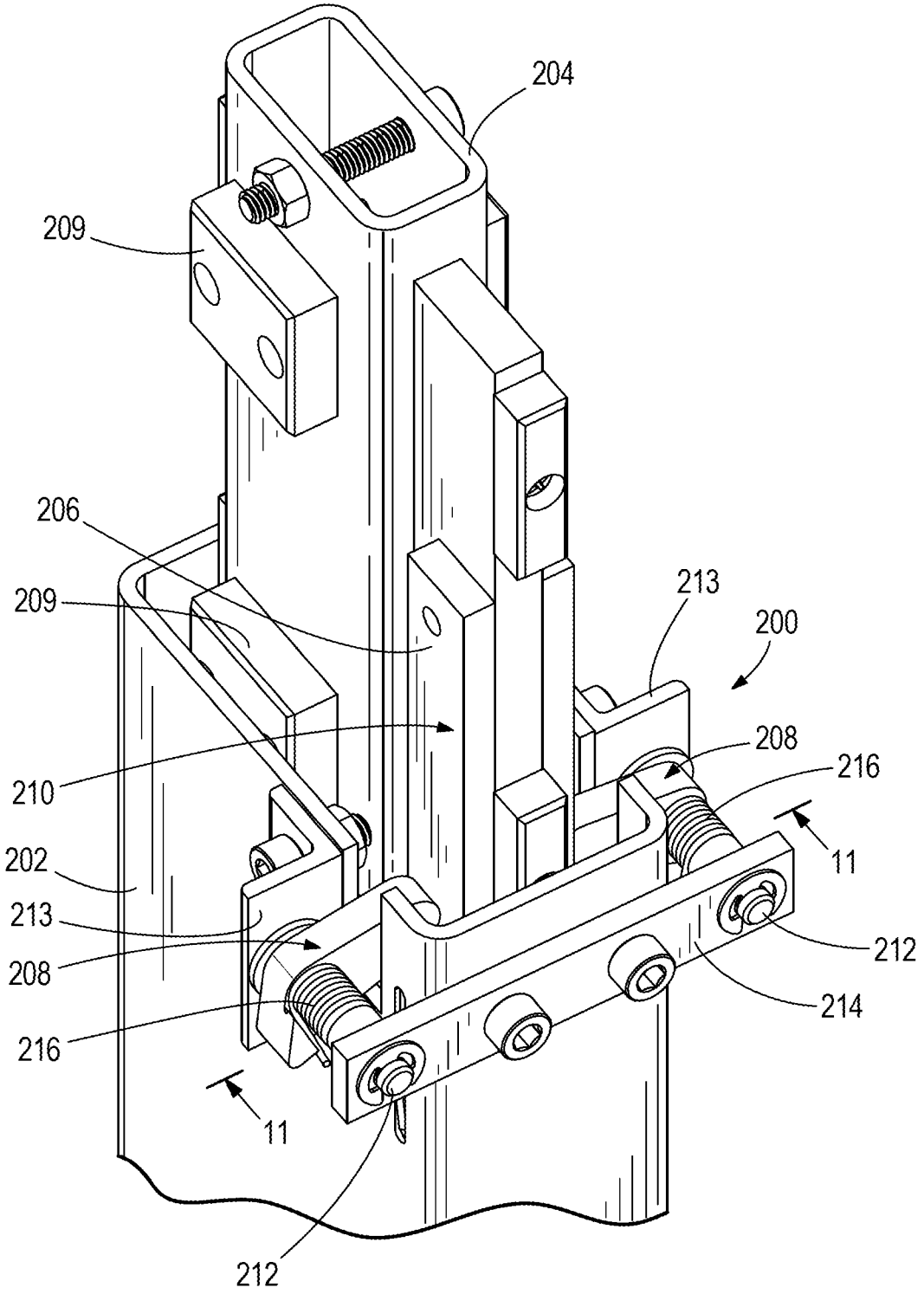
FIG. 10 is a perspective view of the first and second frame members and a second embodiment of the locking device according to the present disclosure.
Figure 12:
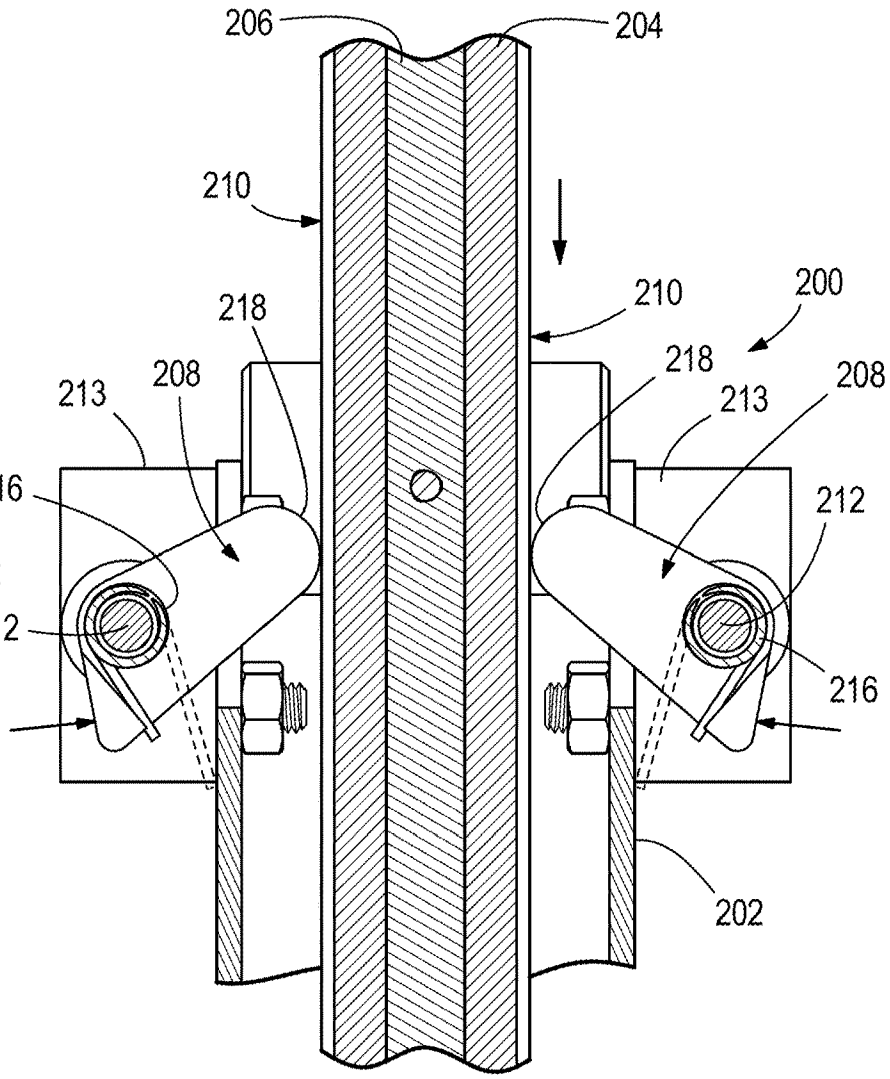
FIG. 12 is a sectional side view of the first and second frame members, showing the second embodiment of the locking device in the unlocked position.
Figure 11:
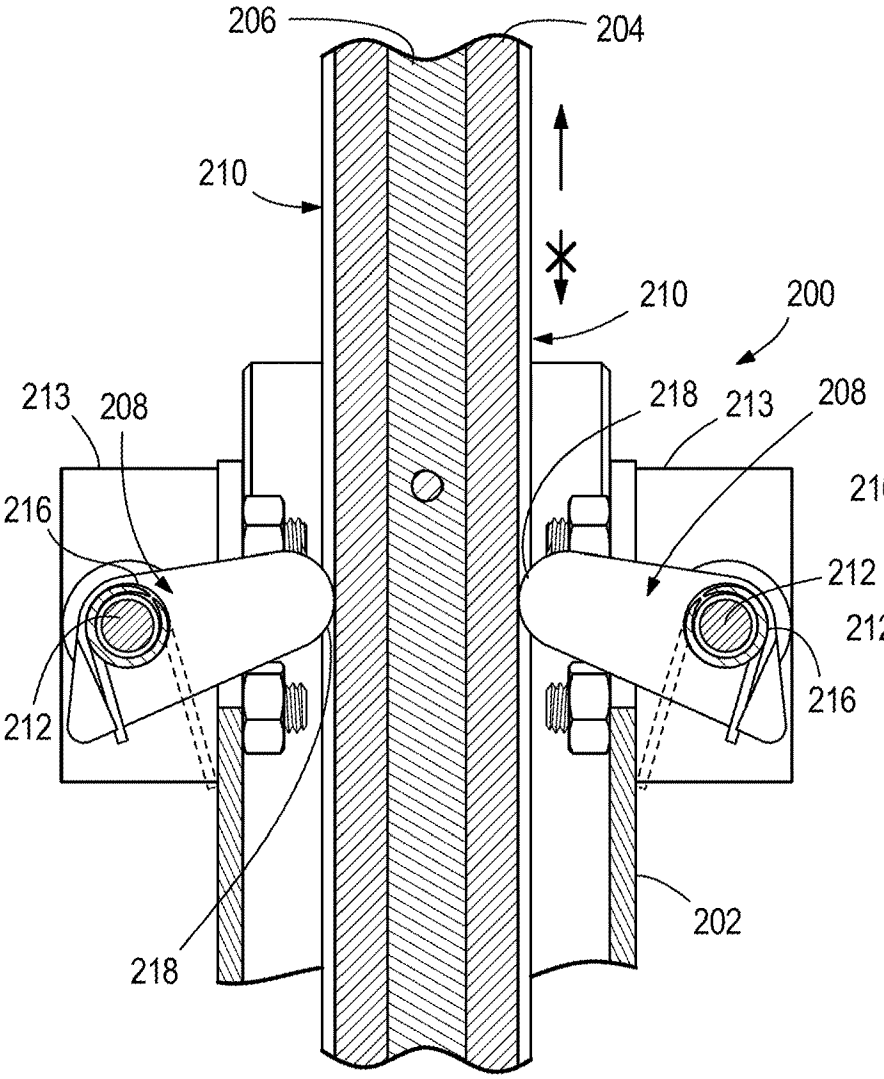
FIG. 11 is a sectional side view of the first and second frame members, showing the second embodiment of the locking device in the locked position.

FIGS. 10-12 depict a second embodiment of a locking device 200 according to the present disclosure for locking a seat post 204 in position with respect to a rear support column 202, for use in the exemplary stationary bicycle 20 shown in FIG. 1. In the second embodiment, a fin 206 longitudinally extends along the seat post 204, as shown. One or more slide bearings 209 are disposed between the seat post 202 and rear support column 204 and promote smooth sliding of the seat post 204 with respect to the rear support column 202. Unlike the first embodiment in which the cams 42 engage with the inwardly facing engagement surfaces 56, the locking device 200 has a pair of cams 208 that are radially inwardly oriented towards each other and configured to engage with radially opposite and outwardly facing engagement surfaces 210 on the fin 206. The cams 208 are rotatable about respective pivot axles 212, which are mounted to opposite sidewalls of the rear support column 202 by opposing flanges 213 and a common mounting bracket 214. Unlike the first embodiment, the cams 42 remain stationary with the rear support column 202 as the seat post 204 is telescopically moved with respect to rear support column 202. Torsion springs 216 are mounted on the pivot axles 212 and bias the cams 208 into the locked position against the radially opposite engagement surfaces 210. Each torsion spring 216 has a first end affixed to the pivot axle 212 and a second end affixed to the cam 208 in a manner similar to the first embodiment. Each torsion spring 216 provides a spring biasing force on its associated cam 208 so as to cause the cam 208 to automatically rotate about the pivot axle 212 into the locked position shown in FIG. 11. In the locked position the cam 208 abuttingly engages with the fin 206 and prevents downward movement of the seat post 204 in the rear support column 202.

Just like the first embodiment, as described herein above, in the locked position the locking device 200 permits sliding movement of the seat post 204 upwardly with respect to the rear support column 206, as the cams 42 freely slide upwardly along the radially opposite engagement surfaces 210. Just like the first embodiment, as described herein above, the cams 208 each advantageously have an outer engagement surface 218 having a contour that follows a logarithmic spiral curve defined by the following parametric equation: $x(t)=r(t)\cos(t)=ae^{bt}\cos(t)$, and $y(t)=r(t)\sin(t)=ae^{bt}\sin(t)$, wherein e is the base of natural logarithms and a and b are arbitrary positive real constants.

Figure 13:
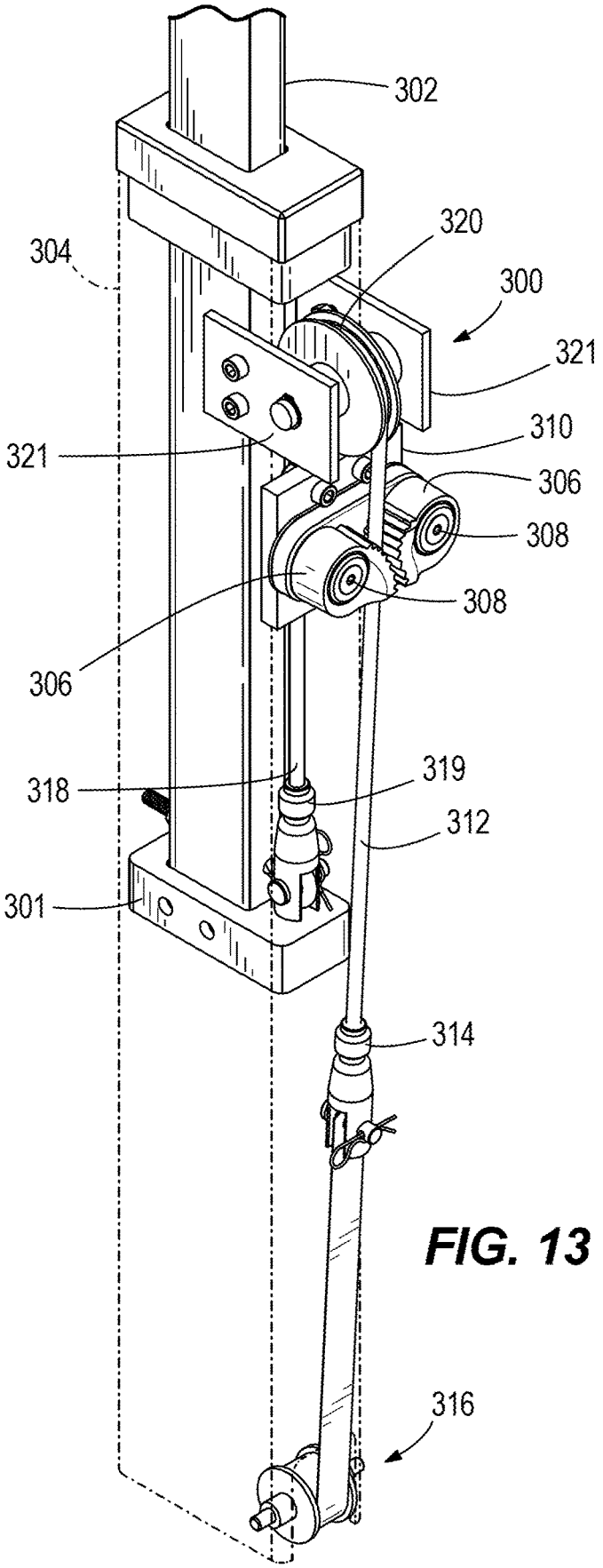
FIG. 13 is a perspective view of first and second frame members and a third embodiment of al locking device according
Figure 14:
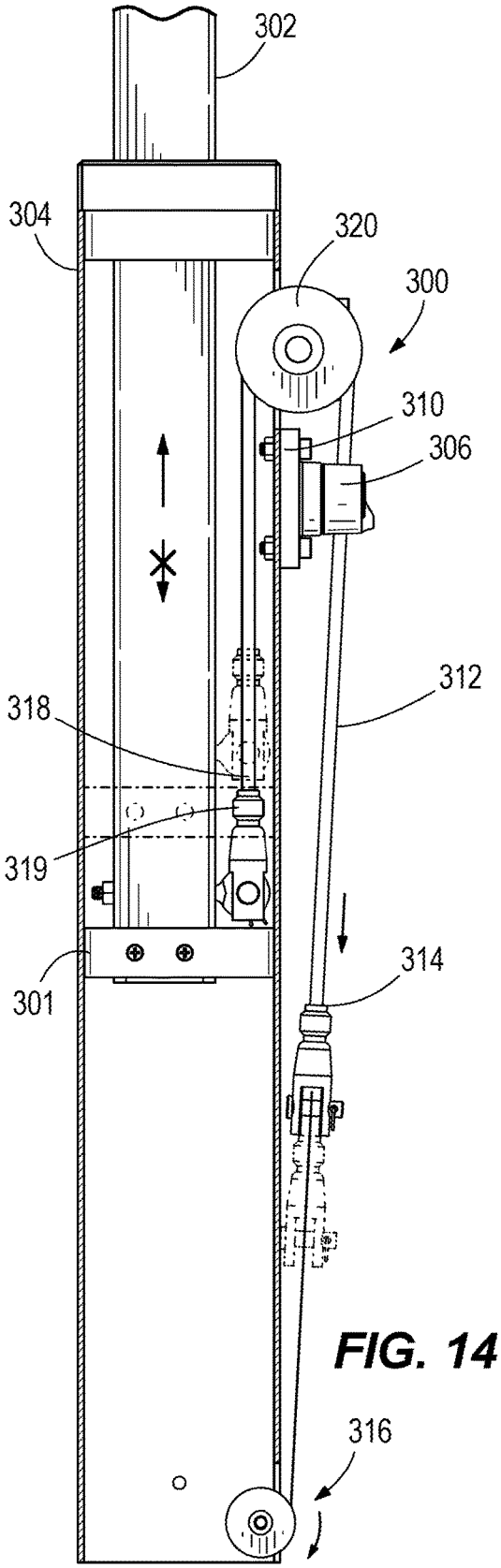
FIG. 14 is a sectional side view of the third embodiment.
Figure 15:
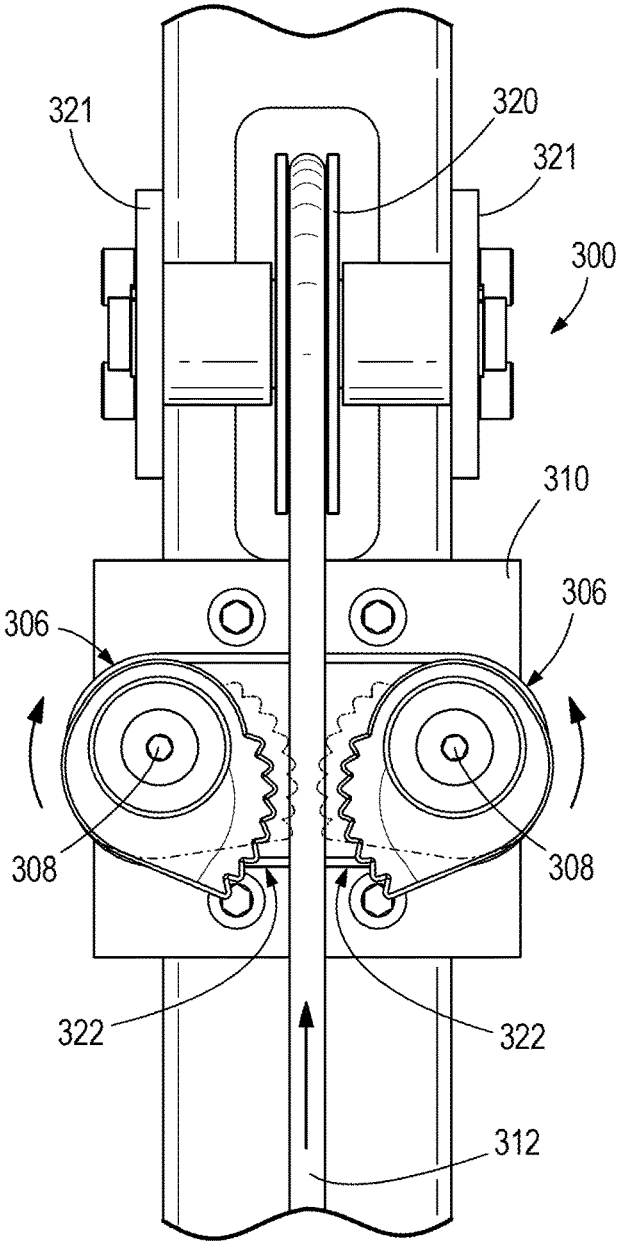
FIG. 15 is a front view of the fourth embodiment.

FIGS. 13-15 depict a third embodiment of a locking device 300 according to the present disclosure for retaining a seat post 302 in position with respect to a rear support column 304. Similar to the second embodiment, the locking device 300 has a pair of cams 306 that are oriented inwardly towards each other. Each of the cams 306 is mounted to the rear support column 304 by respective pivot axles 308, which are supported on a common mounting bracket 310 on a sidewall of the rear support column 304. A pulley cable 312 has a first end 314 affixed to the outside of the rear support column 304, and a second end 318 affixed to a base member 301 that also provides a slide bearing on the lower end of the seat post 302. The first end 314 is affixed to the rear support column 304 via a conventional spring-biased tape retractor mechanism 316 that automatically pulls the pulley cable 312 into a spool, similar to a conventional tape measure retractor mechanism. The second end 318 is affixed to the base member 301 on the seat post 302 by a locking nut 319. The pulley cable 312 is routed around a pulley wheel 320 rotatably mounted on the outside of the rear support column 304 by a pair of brackets 321 and a center axle 323 extending between the brackets 321. As shown in FIG. 14, manually raising the seat post 302 out of the rear support column 304 unwinds the pulley cable 312 from the spring-biased tape retractor mechanism 316. Manually lowering the seat post 302 into the rear support column 304 allows the spring-biased retractor mechanism 316 to automatically pull the pulley cable 312 onto its spool.

Similar to the second embodiment described herein above, the pair of cams 306 are spring-biased into a locked position, wherein the pair of cams 306 are rotated towards each other so as to abuttingly engage and pinch the pulley cable 312, thus preventing the pulley cable 312 from moving in the direction of arrow 303, which prevents the seat post 302 from being lowered. This retains the seat post 302 into position with respect to the rear support column 304 under the force of gravity and when the user sits on the seat 30. Just like the first and second embodiments, the pair of cams 306 each advantageously have an outer engagement surface 322 having a contour that follows a logarithmic spiral curve defined by the following parametric equation: $x(t)=r(t)\cos(t)=ae^{bt}\cos(t)$, and $y(t)=r(t)\sin(t)=ae^{bt}\sin(t)$, wherein e is the base of natural logarithms and a and b are arbitrary positive real constants. In the illustrated example, the outer engagement surface 322 is ribbed to facilitate engagement with the pulley cable 312.

It is contemplated that a release mechanism can be provided for the second and third embodiments, having similar functionality to the first embodiment. For example one or more manual levers can be attached to the cams of the second and third embodiments, allowing the user to cause the cams to rotate out of the locked position, against the spring bias.

The present disclosure thus provides exercise machines having a first frame member, a second frame member that is movable with respect to the first frame member, and a locking device comprising at least one cam that is rotatable into and between a locked position in which the cam abuttingly engages and thereby retains the second frame member in position with respect to the first frame member and an unlocked position in which the cam is spaced from the second frame member and thereby frees the second frame member for movement with respect to the first frame member. As described herein above, the cam advantageously has an engagement surface with an outer contour that follows a logarithmic spiral curve defined by the following parametric equation: $x(t)=r(t)\cos(t)=ae^{bt}\cos(t)$ and $y(t)=r(t)\sin(t)=ae^{bt}\sin(t)$, wherein e is the base of natural logarithms and a and b are arbitrary positive real constants. In the illustrated embodiments, the second frame member is telescopically movable with respect to the first frame member. A spring that biases the cam towards the locked position, wherein the spring provides a spring force that is strong enough to normally bias cam into engagement with the second frame member. A release device is for manually unlocking the locking device.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. An exercise machine comprising:

a first frame member;

a second frame member that is movable with respect to the first frame member; and a locking device comprising at least one cam that is rotatable into and between a locked position in which the cam abuttingly engages and thereby retains the second frame member in position with respect to the first frame member and an unlocked position in which the cam is spaced from the second frame member and thereby frees the second frame member for movement with respect to the first frame member;

wherein the cam has an engagement surface with an outer contour that follows a logarithmic spiral curve defined by the following parametric equation:

$$x(t)=r(t)\cos(t)=ae^{bt}\cos(t)$$

$$y(t)=r(t)\sin(t)=ae^{bt}\sin(t)$$

wherein e is the base of natural logarithms and a and b are arbitrary positive real constants.

2. The exercise machine according to claim 1, wherein the second frame member is telescopically movable with respect to the first frame member.

3. The exercise machine according to claim 1, wherein the cam is one of a pair of identical cams.

4. The exercise machine according to claim 1, wherein the first frame member comprises a column having an inwardly facing engagement surface, and wherein the cam is disposed in the column and abuttingly engages with the inwardly facing engagement surface in the locked position.

5. The exercise machine according to claim 1, further comprising a fin that longitudinally extends with respect to the first and second frame members, and wherein the cam engages with an engagement surface on the fin in the locked position.

6. The exercise machine according to claim 1, wherein the cam is one of a pair of cams, and further comprising a pulley cable having a first end coupled to the first frame member and a second end coupled to the second frame member, and wherein the pair of cams are rotatable towards each other to pinch the pulley cable and thereby lock the second frame member in position with respect to the first frame member.

7. The exercise machine according to claim 1, wherein the cam is rotatable about a pivot axle.

8. The exercise machine according to claim 1, wherein the cam is one of a pair of identical cams that together abuttingly engage and lock the second frame member with respect to the first frame member.

9. The exercise machine according to claim 1, further comprising a spring that biases the cam towards the locked position, wherein the spring provides a spring force that is strong enough to normally bias cam into engagement with the second frame member.

10. The exercise machine according to claim 1, wherein the cam in the locked position is slide-able along the first frame member as the second frame member is moved with respect to the first frame member in a first direction but in the locked position is caused to engage with the first frame member and prevents movement of the second member with respect to the first frame member in an opposite, second direction.

11. The exercise machine according to claim 1, wherein the cam is coupled to and travels with the second frame member as the second frame member is moved relative to the first frame member.

12. The exercise machine according to claim 1, wherein the cam is coupled to and remains with the first frame member as the second frame member is moved relative to the first frame member.

13. The exercise machine according to claim 1, further comprising a release device for manually unlocking the locking device.

14. The exercise machine according to claim 13, wherein the release device comprises a handle that is manually movable in a first direction to unlock the locking device and in an opposite second direction to lock the locking device.

15. The exercise machine according to claim 14, wherein the handle is coupled to the second frame member along a pivot axis about which the handle is pivotable in the first and second directions.

16. The exercise machine according to claim 14, wherein the release device comprises a push rod coupled to the handle, wherein moving the handle in the first direction moves the push rod into engagement with the cam and thereby unlocks the locking device, and wherein moving the handle in the second direction moves the push rod out of engagement with the cam and thereby unlocks the locking device.

17. The exercise machine according to claim 16, wherein the cam has a camming surface that is engaged by the release device when the handle is pivoted in the first direction.

18. The exercise machine according to claim 17, further comprising an engagement member on the push rod, wherein the cam is one of a pair of cams, each having the camming surface that is engaged by the engagement member.

19. The exercise machine according to claim 1, wherein the first frame member is a support column and the second frame member is a seat post that extends into the support column.

20. An exercise machine comprising:

a first frame member;

a second frame member that is telescopically movable with respect to the first frame member; and a locking device comprising a pair of cams that are rotatable into and between a locked position in which the pair of cams abuttingly engages and thereby retains the second frame member in position with respect to the first frame member and an unlocked position in which the pair of cams is spaced from and thereby frees the second frame member for movement with respect to the first frame member;

wherein each cam in the pair of cams has an engagement surface with a contour that follows a logarithmic spiral curve defined by the following parametric equation:

$$x(t)=r(t)\cos(t)=ae^{bt}\cos(t)$$

$$y(t)=r(t)\sin(t)=ae^{bt}\sin(t)$$

wherein e is the base of natural logarithms and a and b are arbitrary positive real constants.

* * * * *